US006982735B2

(12) United States Patent
Moore et al.

(10) Patent No.: US 6,982,735 B2
(45) **Date of Patent: *Jan. 3, 2006**

(54) IMAGING SYSTEMS AND METHODS

(75) Inventors: Robert A. Moore, Mashpee, MA (US); John F. Cooper, Harwich, MA (US); Richard A. Fotland, Franklin, MA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/769,530

(22) Filed: Jan. 30, 2004

(65) Prior Publication Data

US 2005/0168558 A1 Aug. 4, 2005

(51) Int. Cl.
*B41J 2/415* (2006.01)

(52) U.S. Cl. ..... 347/125; 101/492

(58) Field of Classification Search ..... 101/492; 347/55, 120, 125–128, 131, 147, 158, 58, 347/154, 163, 173, 111, 159; 399/168, 169, 399/271, 290, 292, 293, 294, 295; 430/114, 430/116, 119, 62, 66; 427/303, 327
See application file for complete search history.

(56) References Cited

U.S. PATENT DOCUMENTS

| | | | | |
|---|---|---|---|---|
| 3,669,073 | A * | 6/1972 | Savit et al. | 399/240 |
| 3,892,645 | A | 7/1975 | Castegnier | |
| 4,895,629 | A | 1/1990 | Castegnier | |
| 5,153,618 | A * | 10/1992 | Frank et al. | 347/125 |
| 5,510,817 | A | 4/1996 | Sohn | |
| 5,745,128 | A * | 4/1998 | Lam et al. | 346/140.1 |
| 5,966,570 | A | 10/1999 | Till et al. | |
| 6,221,138 | B1 | 4/2001 | Kenny | |
| 6,419,987 | B1 * | 7/2002 | Bauer et al. | 427/302 |
| 6,536,876 | B1 | 3/2003 | Fotland et al. | |
| 6,719,423 | B2 * | 4/2004 | Chowdry et al. | 347/103 |
| 6,862,031 | B1 * | 3/2005 | Moore et al. | 347/125 |

* cited by examiner

*Primary Examiner*—Ren Yan

(57) ABSTRACT

Imaging systems and methods are described. In one aspect, an ink layer having an electrorheological fluid composition including a suspension of colorant particles dispersed in an electrically insulating carrier fluid is formed on a surface. A charge image is projected onto the ink layer to selectively form charge-stiffened regions adhering to the electrically insulating layer and representing respective regions of the projected charge image. Non-charge-stiffened ink layer components are physically separated from the charge-stiffened regions. Portions of the ink layer are electrostatically transferred to a receptor substrate.

40 Claims, 3 Drawing Sheets

IMAGING SYSTEMS AND METHODS

FIELD OF THE INVENTION

The invention relates to imaging systems and methods.

BACKGROUND OF THE INVENTION

Traditional methods of imaging (or printing) use various types of long-run print forms, such as gravure cylinders, offset plates and flexographic belts, which carry a recorded representation of a desired image (or "signature"). For example, lithographic offset printing methods typically use aluminum plates carrying imagewise signatures on rasterized ink-accepting and ink-repellant areas. A lithographic offset plate usually is imaged by applying an ultraviolet contact photography process to a sheet of silver film. In this process, exposed raster dot areas are etched from an initial ink-accepting state into a water-accepting state; unexposed raster dot areas remain in an ink-accepting state. Lithographic inks are typically hydrophobic, exhibit high viscosities and contain small amounts of solvent.

Other imaging methods, such as marking methods, do not require printing forms. For example, ink jet printing produces images by ballistically jetting a serial sequence of ink droplets from a distance onto a substrate (e.g., a paper sheet). Ink jet printing inks generally are volatile, exhibit low viscosity, and may be loaded into an ink jet printer in a liquid or a solid state. Some solid ink jet inks may be activated by heating. Other solid ink jet inks, such as inks containing rheological fluids, may be activated in other ways. Magneto-rheological fluids are responsive to magnetic fields, whereas electro-rheological fluids are responsive to electric fields. One system has proposed an ink composition that is suitable for use in ink jet printing and includes a coloring agent and a carrier containing a magneto-rheological fluid with viscosity and flow properties that may be controlled by an applied magnetic field. Another system has proposed an ink jet ink composition that includes an electro-rheological fluid that enables the ejection of ink to be controlled by applying an electric field that varies the viscosity of the ink and by creating a pressure difference in a venturi tube.

Electrostatic printing methods also do not require printing forms. In these methods, a discharge source typically deposits imagewise electrostatic charges onto a dielectric member (e.g., a plate or a drum) to generate an electrostatic latent image on the dielectric member. The latent image is developed into a visible image by depositing a charged developing material onto the surface of the dielectric member. Charged solids in the developing material adhere to image areas of the latent image. The developing material typically includes carrier granules having charged marking or toner solids that are electrostatically attracted from the carrier granules to the latent image areas to create a powder toner image on the dielectric member. In another electrostatic imaging method, an electrostatic latent image is formed directly in a layer of toner material as opposed to on a dielectric member.

In this method, an image separator is electrically biased to selectively attract either image or non-image areas of the latent image formed in the toner layer. In one process, latent images are formed by electrocoagulation of an ink composition. In particular, the electrocoagulation involves an electrochemical reaction that affects an electrolytically sensitized polymeric ink. In this process, very short electric pulses are applied to a colloidal ink solution that is sandwiched between a cathode electrode array and a passivated rotating electrode. The electrocoagulated ink adheres firmly to the positive electrode imaging cylinder. The adhered ink is transferable to plain paper after surplus ink has been removed. The ink is composed of a common linear, waste-water treatment polymer. The polymer is in suspension in water and forms a network that has a tendency to fold onto itself in the presence of metallic ions. The solvent is water mixed with electrolytic salts that render the ink electrically conductive.

SUMMARY OF THE INVENTION

In one aspect, the invention features an imaging method. In accordance with this inventive method, an ink layer having an electrorheological fluid composition comprising a suspension of colorant particles dispersed in an electrically insulating carrier fluid is formed on a surface. A charge image is projected onto the ink layer to selectively form charge-stiffened regions adhering to the electrically insulating layer and representing respective regions of the projected charge image. Non-charge-stiffened ink layer components are physically separated from the charge-stiffened regions. At least a portion of the ink layer is electrostatically transferred to a receptor substrate.

In another aspect, the invention features an imaging system, comprising an electrically insulating layer supported by an electrically conducting substrate, an inking system, a charge imaging print-head, a developer assembly, and a transfer assembly. The inking system is operable to form on a surface an ink layer having an electrorheological fluid composition comprising a suspension of colorant particles dispersed in an electrically insulating carrier fluid. The charge imaging print-head is operable to project a charge image onto the ink layer to selectively form charge-stiffened regions adhering to the electrically insulating layer and representing respective regions of the projected charge image. The developer assembly is operable to apply a shearing force to the ink layer to physically separate non-charge-stiffened ink layer components from the charge-stiffened regions. The transfer assembly is operable to transfer at least a portion of the ink layer to a receptor substrate.

Other features and advantages of the invention will become apparent from the following description, including the drawings and the claims.

DETAILED DESCRIPTION OF THE INVENTION

In the following description, like reference numbers are used to identify like elements. Furthermore, the drawings are intended to illustrate major features of exemplary embodiments in a diagrammatic manner. The drawings are not intended to depict every feature of actual embodiments nor relative dimensions of the depicted elements, and are not drawn to scale.

Figure 1A:
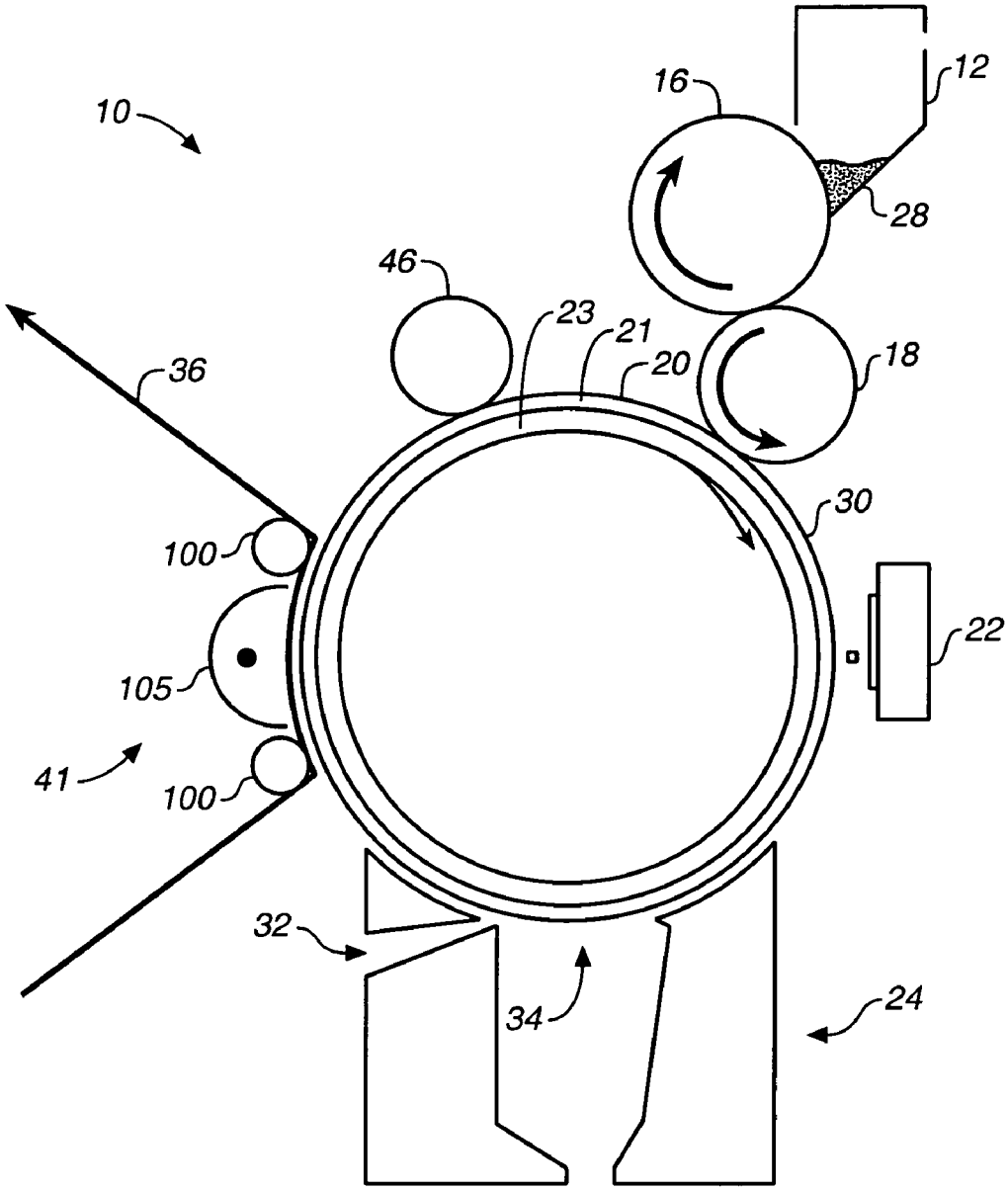
FIG. 1 is a diagrammatic side view of an imaging system, according to an embodiment of the present invention.
Figure 1B:
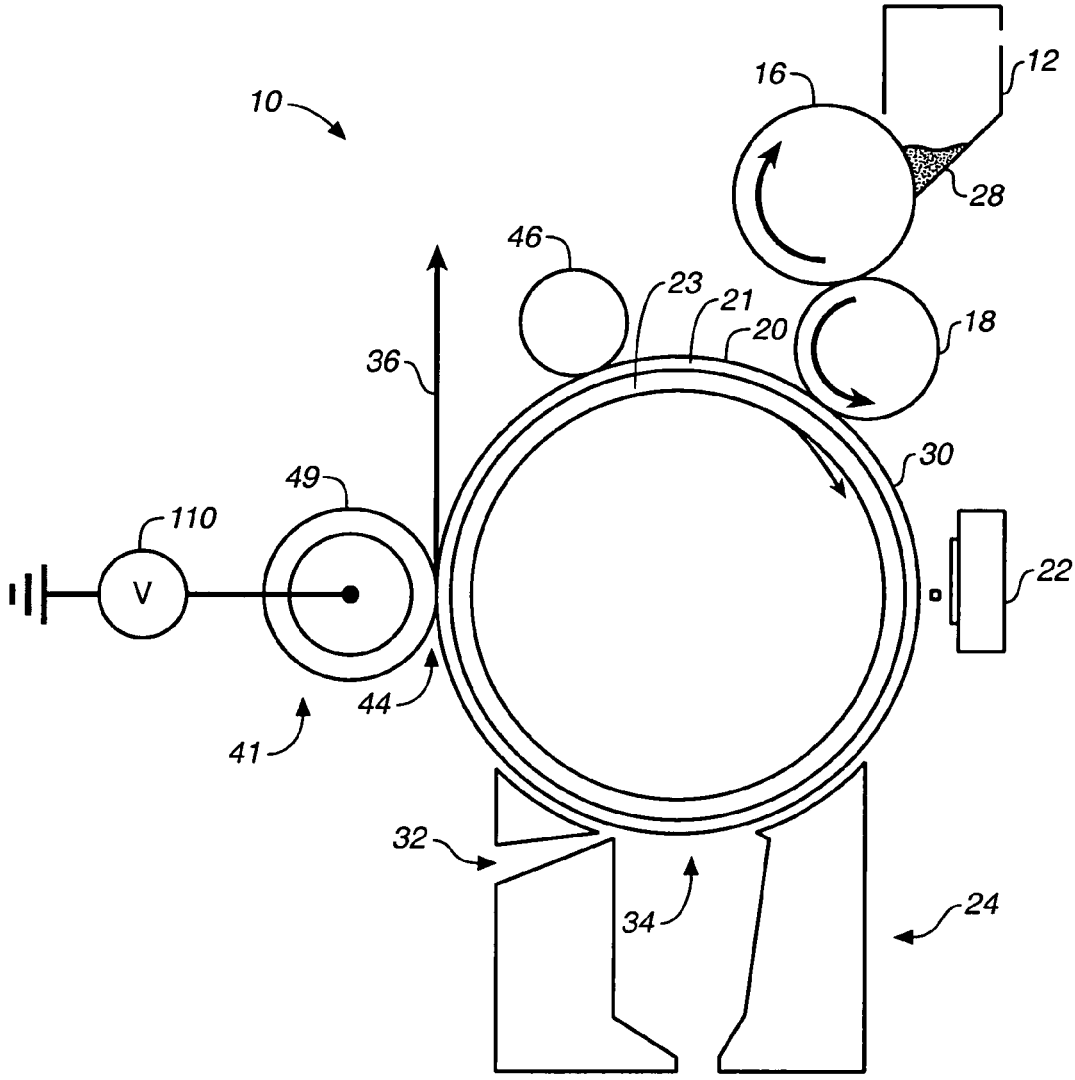

Referring to FIGS. 1A and 1B, in embodiments of the invention, an imaging system 10 includes an ink supply 12, a set of inking rollers 16, 18, an imaging roll 20, a charge imaging print-head 22, a developer assembly 24, and an impression roll assembly 26.

In the illustrated embodiments, inking roller 16 is implemented as a conventional anilox roller that is configured to meter precise amounts of ink 28 from supply 12 onto inking roller 18. Inking roller 18 preferably is implemented as a conventional ink form roller that is configured to apply a uniform thin ink layer onto the surface of imaging roll 20. In some embodiments, the selected wet ink layer thickness depends upon the desired dry ink layer thickness and the percentage of colorant solids in the ink layer composition. In the illustrated embodiments, an ink layer formed on the surface of imaging roll 20 preferably has a wet film thickness of about 3–100 microns, and more preferably has a wet film thickness of about 15–30 microns.

The surface of imaging roll 20 is electrically insulating in some embodiments (e.g. with a resistivity that is greater than $10^6$ ohm-cm). In the illustrated embodiment, the surface of imaging roll 20 is an electrically insulating layer 21 on an electrically conducting substrate 23 (e.g., with a resistivity that is less than $10^6$ ohm-cm). In the illustrated embodiment, insulating layer 21 is implemented as a glass layer. In the illustrated embodiment, the glass layer has a thickness of about 50 micrometers. In other embodiments, the glass layer thickness may range from 1 to 500 micrometers. In other embodiments, the electrically insulating layer may be made from other electrically insulating materials including polymers such as polyester (such as Mylar®), polyimide (such as Kapton®), polyvinylidenefluoride (such as Kynar®), flame spray or thermal spray deposited ceramics, anodically sprayed oxides and CVD coatings. The material composition of the electrically insulating layer 21 is generally chosen for optimum surface energy and/or wettability to optimize the removal of the unexposed ink layer and/or transfer of the remaining ink in the image from the insulating layer to a print medium (e.g. paper) for best image quality. In the embodiment shown in FIG. 1, the electrically conducting substrate 23 is implemented as a metal cylinder.

The electrically insulating layer 21 further improves the operation of the printing apparatus by allowing efficient localized heating of the image. In some embodiments, localized heating is used to remove unwanted carrier fluid prior to transferring the ink from the imaging roller 20 to a printing medium. Without electrically insulating layer 21, heat may be too rapidly conducted into the conducting substrate, preventing or slowing the localized heating.

In other embodiments, the electrically insulating layer 21 is not present, and the imaging roll 20 has an electrically conducting surface.

Charge imaging print-head 22 may be implemented as a conventional masked corona generating electrode and preferably has a resolution of 300 to 1,200 dots per inch (dpi) or any intermediate resolution such as 600 dpi, 740 dpi, 1000 dpi, and the like. Higher and lower resolutions may also be utilized, in some embodiments. In operation, charge imaging print-head 22 and imaging roll 20 are configured to cooperatively project a charge image onto the surface of the ink layer 30. Positive or negative corona charging may be used. As explained in detail below, ink layer 30 has an electrorheological fluid composition. By electrorheological fluid composition, herein is generally meant that the viscosity of the fluid changes when exposed to charge species delivered by charge imaging print-head 22. In embodiments of the invention described further below, the viscosity of the exposed ink regions increase—also sometimes referred to as the exposed regions stiffening. In accordance with embodiments of the invention, the unexposed regions of ink layer 30 remain unchanged. The charge-stiffened ink layer regions adhere to the surface of imaging roll 20 by electrostatic attraction. In the illustrated embodiment, the projected charge image corresponds to the desired final image to be transferred to a receptor substrate, such as a paper sheet (or web). In other embodiments, the projected charge image may correspond to a reverse image of the desired final image, in which case the uncharged ink layer regions correspond to the desired final image.

In the illustrated embodiment, developer assembly 24 is configured to apply a shearing force to ink layer 30 to physically separate non-charge-stiffened ink layer components from the charge-stiffened regions. In this embodiment, developer assembly 24 includes an air vent 32 that is configured to deliver a sheet of gas flow across the surface of ink layer 30 and a vacuum port 34 that is configured to generate a region of reduced air pressure in the vicinity of the ink layer 30. Air vent 32 may be implemented as a conventional air knife generating air vent, such as an EXAIR® air knife, available from EXAIR Corporation of Cincinnati, Ohio, U.S.A. In operation, the sheet of gas flow delivered from air vent 32 strips non-charge-stiffened ink layer components from the surface of imaging roll 20. The stripped ink layer components are sucked through vacuum port 34 into an ink reservoir, where they may be discarded or recycled.

After the non-charge-stiffened ink layer components have been scavenged from the surface of imaging roll 20, the remaining charge-stiffened ink layer regions may be electrostatically transferred to a receptor substrate 36 (e.g., a sheet of paper). A transfer assembly 41 is provided to facilitate the electrostatic transfer. In the embodiment shown in FIG. 1A, the transfer assembly 41 is implemented as a corona charge generator unit 105 for charging the receptor substrate 36. Optional paper guide rollers 100 are further included in the transfer assembly 41 for guiding substrate 36 in proximity of the imaging roller 20. In the illustrated embodiment of FIG. 1B, the transfer assembly is implemented as a device 110 to apply an electrical bias to transfer roll 49, which applies a bias to the receptor substrate 36 by pressure contact. The receptor substrate is brought into moving contact at the image transfer point and an electrostatic field applied between the uncontacted surface of the receptor substrate and the image drum. As shown in FIGS. 1A and 1B, this field may be established either through the use of the corona charge generator unit 105 or the electrically biased transfer roll 49.

In some embodiments, the receptor substrate is a print media—for example, paper, transparencies, textiles, thin films, glass substrates, or the like. In some embodiments, the receptor substrate is an intermediate image carrier—such as an elastomer image carrier. The ink layer may be further treated on the elastomer image carrier, in some embodiments, prior to a transfer from the image carrier to a print media.

An optional cleaning roller 46 (for example, a conventional cloth covered roller) may be used to physically remove residual ink layer components from the surface of imaging roll 20 before a new ink layer is formed.

Figure 2:
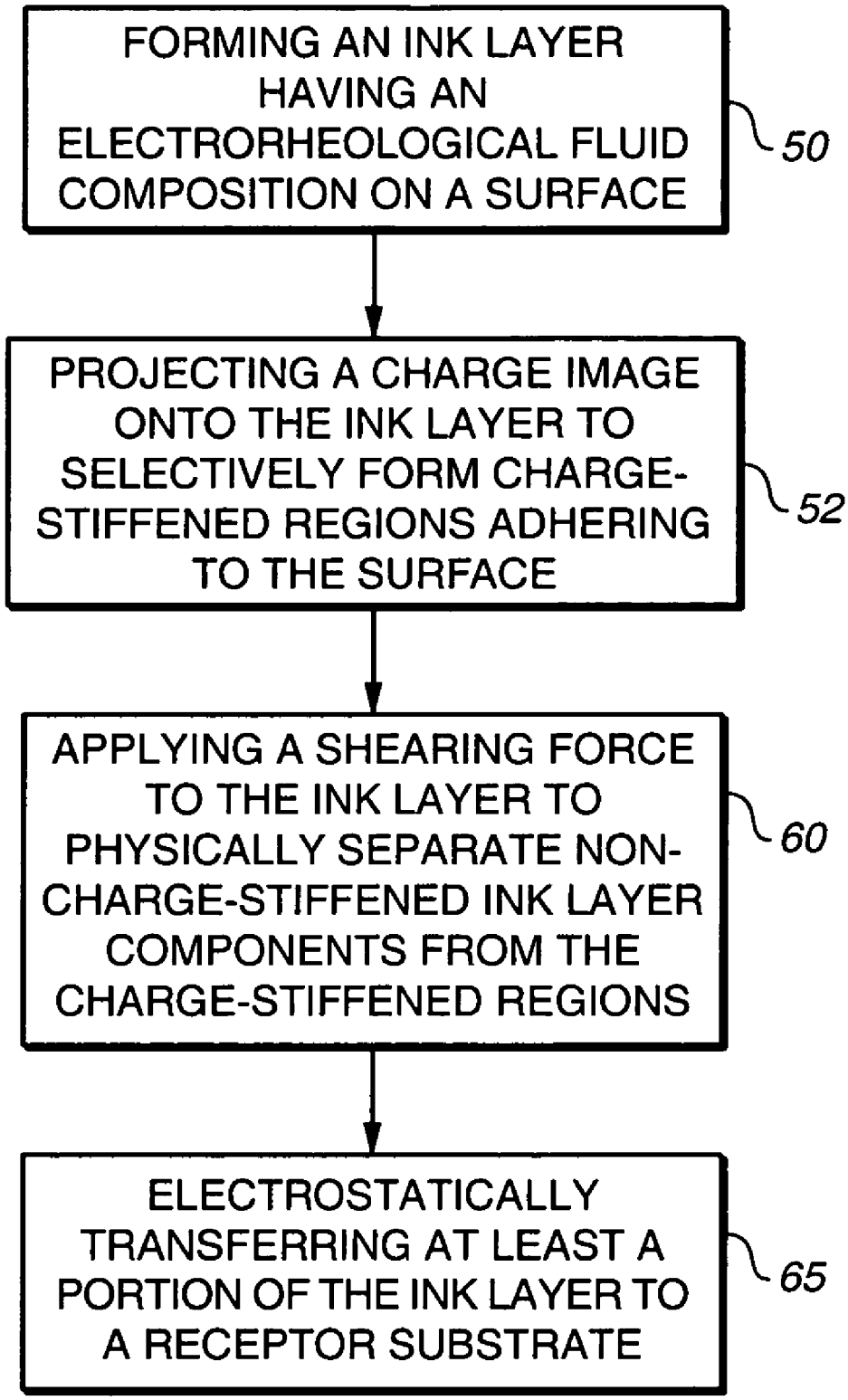
FIG. 2 is a flow diagram of an imaging method, according to an embodiment of the present invention.

The following description tracks the flow diagram of FIG. 2 and provides additional details regarding the imaging scheme outlined above in connection with the exemplary imaging system 10 of FIG. 1.

As explained above, in operation, imaging system 10 forms on a surface an ink layer having an electrorheological fluid composition (step 50; FIG. 2). The electrorheological fluid composition includes a suspension of colorant particles dispersed in an electrically insulating carrier fluid. In general, the ink composition includes one or more conventional standard ink pigments dispersed in a resin vehicle. Pigment concentrations may be in the range of 2% to 50% by volume. The pigment dispersed resin vehicle may be dispersed as colloidal particles in an electrically insulating liquid carrier in which the resin is insoluble. A second resin may or may not be dissolved in the liquid carrier. In some embodiments, the carrier fluid may be formed from one or more of paraffinics, paraffin oil, aliphatic ink oils, and mineral oil. The pigment/resin concentration may be adjusted to provide an ink viscosity in the range of preferably 50–5000 centipoise (cp) and, more preferably, in the range of 100 to 1,000 cp, with a solids concentration of about 10% by volume.

In some embodiments, pigment particles are milled directly into the carrier fluid. Additional additives/dispersants may be used with some of these pigment-only inks. These inks may be prepared by ball milling and pigment particle sizes preferably are small (e.g., less than 1 micron), with some larger agglomerates. In other embodiments, the ink composition may include pigment/polymer concentrates, with or without additional additives. These concentrates may be obtained from pigment suppliers, such as Sun Chemical or Clariant, or may be formulated from raw pigments and resins using a two- or three-roll mill or extruder. The concentrates preferably are milled to smaller than 5 microns in size, with smaller fractions produced by classifying particles that are less than 2 microns. A list of exemplary pigment-only and concentrate-based ink formulations can be found in U.S. Pat. No. 6,536,876, incorporated herein by reference in its entirety.

Milled pigment/polymer concentrates may be prepared with or without Picco 5120 resin or some other Hydrocarbon resin. Pigment (no polymer) inks may be prepared using glycerin, esteramide wax and maleic anhydride-modified polyethylene as additives. In some embodiments, the pigment and additive are media milled together. Some of these compositions may include two different concentrations of the additive.

Acrylic, glycerin and Kraton rubber additions and/or pigment treatments have been shown to positively influence ink development. Other dispersants/pigment treatments also may be used to modify surface tension, viscosity, and reduce background staining via reduced adhesion.

Exemplary ink raw materials and exemplary ink preparation procedures are also identified in U.S. Pat. No. 6,536,876, incorporated herein by reference.

After the ink layer has been formed on the surface on imaging roll 20 (step 50; FIG. 2), a charge image is projected onto the ink layer to selectively form charge-stiffened regions adhering to the surface and representing respective regions of the projected charge image (step 52; FIG. 2).

Without being bound by theory, the charged species generated by charge imaging print-head 22 appears to convert the viscous liquid ink into a stiffened ink layer. Very high sensitivity may be realized because field forces only have to overcome Stokes drag and very weak particle-particle dispersive forces. The charged regions of ink layer 30 exhibit an increase in viscosity under the action of the applied electric field. Positive or negative ion sources are used in embodiments of the invention to form the latent image. Generally, charge retention by the ink layer after exposure from charge imaging print-head 22 appears greater when the ink layer is on an insulating layer 21 and not directly on the electrically conductive substrate 20. The charge retained assists in holding the ink in place when unexposed ink is removed, improving the stability of the ink image and resulting in higher image quality.

Measurements indicate that a charge exposure of about 1 nanocoulomb/cm$^2$ provides a developable image, in some embodiments of the invention. This charge level is about $1/20^{th}$ of the charge level that typically is required for ebi (ion) printers and about $1/40^{th}$ of the charge level that typically is required for laser printers. A charge exposure of about 2 nanocoulomb/cm$^2$ produces a developable image in other embodiments, a charge exposure of about 3 nanocoulomb/cm$^2$ produces a developable image in other embodiments, and a charge exposure of about 4 nanocoulomb/cm$^2$ produces a developable image in other examples. The particular charge exposure densities used depend on the ink composition used, and desired resolution. In the illustrated embodiments, typical charging charge exposure levels may be between about 1–100 nanocoulomb/cm$^2$, in other embodiments between about 5–80 nanocoulomb/cm$^2$, in other embodiments between about 10–60 nanocoulomb/cm$^2$, and in other embodiments between about 15–40 nanocoulomb/cm$^2$. Charge exposure levels greater than 100 nanocoulomb/cm$^2$ may also be used.

In the illustrated embodiment, after a charge image is formed (step 52; FIG. 2), a shearing force is applied to the ink layer to physically separate non-charge-stiffened ink layer components from the charge-stiffened regions (step 60; FIG. 2). Since liquid will not support shear forces, the unexposed ink is removed via shear stress while the charge-stiffened solid or semi-solid ink image remains. In some embodiments, the shear stress may be applied by one or more of an air knife, vacuum suction removal, an elastomeric blade, a liquid spray, and a cylindrical roller.

In the exemplary embodiment of FIG. 1, the un-coalesced ink is blown away using an air knife. The air knife preferably is set at an angle of about −90° to 90° and, more preferably, is set at an angle of about 15° with respect to the surface of imaging roll 20. The outlet of the air knife vent preferably is spaced from the imaging roll surface by a distance of about 0.5 to 50 mm. The gas pressure preferably is about 20–60 pounds per square inch gauge (psig), although this parameter may be different for different ink viscosities.

The exemplary embodiment of FIG. 1 also uses vacuum suction to remove non-charged-stiffened ink layer regions. The vacuum source may be a conventional vacuum source, such as a GAST rotary vane pump or an EXAIR®vacuum unit. The vacuum source is mounted such that the vacuum nozzle is spaced above the inked/exposed plate at a controlled gap. In some embodiments, an EXAIR® vacuum unit with a 1 inch (2.5 cm) diameter vacuum opening is used. In these embodiments, the vacuum is created by injecting compressed air into an annular chamber within a 1 inch (2.5 cm) diameter tube with a series of exhaust holes aimed so as to pull a stream of air from one end of the tube, thus creating a vacuum. The compressed air pressure is variable, thus providing an easy method for controlling the vacuum related airflow at the exposed ink surface. The input air pressure controls the volume of air swept over the plate. In these embodiments, the separation gap may range from 1–100 mils (0.025–2.5 mm) and the air pressure may be about 20–100 psi. Vacuum scavenged ink may be returned to an ink reservoir for disposal or reuse.

In some embodiments, a soft squeegee blade (e.g., a soft urethane elastomeric blade) may be gently drawn over the charged ink layer. The un-coalesced ink then may be urged away leaving the solid or semisolid image intact on the surface of the imaging roll 20. In general, the blade edge should be free of debris to provide a smooth contact with the ink bearing substrate. In addition, the blade should be compliant to the image so as not to remove it. For example, in some embodiments, the blade preferably has a durometer hardness of 30 Shore A, or less.

In some embodiments, a liquid spray may be delivered to the surface of the ink layer. The liquid spray preferably dilutes the non-charge-stiffened ink regions and preferably has the same composition as the carrier liquid. In these embodiments, the diluent preferably is delivered before the shearing force is applied. The diluent spray may be applied with an airbrush or a pump dispenser.

In some embodiments, a cylindrical roller may be rolled across the surface of the ink layer to remove non-charge-stiffened ink layer regions. The cylindrical roller may be a hard rubber coated roller (e.g., a conductive 85 Shore A hardness roller with a rather poor surface smoothness).

Portions of the ink layer are electrostatically transferred to a receptor substrate (step 65, FIG. 2). The receptor substrate may be corona charged, or electrically biased by pressure contact with an electrically biased roller. The receptor substrate may be a print media or an intermediate image carrier.

Two or more of the above-described separation methods may be combined in a single imaging system.

In some embodiments, the charge-stiffened regions of the ink layer are separated from the non-charge stiffened regions prior to the electrostatic transfer to the receptor substrate. In other embodiments, the charge-stiffened regions of the ink layer are separated from the non-charged stiffened regions at the same time as or after electrostatic transfer of the ink layer to a receptor substrate. In some embodiments, the charge-stiffened regions of the ink layer represent the desired image. In other embodiments, the non-charge-stiffened regions of the ink layer represent the desired image.

In some embodiments, methods and printing apparatuses are provided for directly imaging on printing media having an insulating surface including, for example, transparencies, textiles, thin films, and glass.

Still other embodiments are within the scope of the claims.

What is claimed is:

1. An imaging method, comprising:

forming on a surface an ink layer having an electrorheological fluid composition comprising a suspension of colorant particles dispersed in an electrically insulating carrier fluid;

projecting a charge image onto the ink layer to selectively form charge-stiffened regions adhering to the surface; and physically separating non-charge-stiffened ink layer components from the charge-stiffened regions; and performing an electrostatic transfer of at least a portion of the ink layer to a receptor substrate.

2. The method of claim 1 wherein the surface comprises an electrically conductive surface.

3. The method of claim 1 wherein the surface comprises an electrically insulating layer supported by an electrically conductive substrate.

4. The method of claim 3 wherein said electrically insulating layer is selected from the group consisting of thermoset resins, thermoplastic resins, inorganic glasses, and inorganic oxides.

5. The method of claim 3 wherein said electrically insulating layer has a thickness from about 1 to 500 micrometers.

6. The method of claim 1, wherein the colorant particles and the electrically insulating carrier fluid are characterized by different respective dielectric constants.

7. The method of claim 6, wherein the dielectric constant of the colorant particles is higher than the dielectric constant of the electrically insulating carrier fluid.

8. The method of claim 1, wherein the colorant particles are characterized by a diameter of about 5 $\mu$m or less.

9. The method of claim 8, wherein the colorant particles are characterized by a diameter of about 1 $\mu$m to about 2 $\mu$m.

10. The method of claim 1 wherein said electrically insulating carrier fluid is selected from the group consisting of aliphatic ink oils, mineral oils, mineral spirits, paraffinic fluids, paraffin oils, Magisol 44, and Isopar.

11. The method of claim 1, wherein the ink layer is characterized by a viscosity of about 50 cps to about 5,000 cps.

12. The method of claim 11, wherein the ink layer is characterized by a viscosity of about 100 cps.

13. The method of claim 1, wherein the ink layer is substantially anhydrous.

14. The method of claim 1, wherein the ink layer has a thickness of about 3 $\mu$m to about 100 $\mu$m.

15. The method of claim 1, wherein projecting the charge image comprises selectively delivering charge species to the Ink layer regions to be charge-stiffened.

16. The method of claim 1, wherein the charge-stiffened regions are characterized by a charge exposure density of about 1–100 nanocoulombs/cm$^2$ .

17. The method of claim 1, wherein non-charge-stiffened ink layer components are physically separated from the charge-stiffened regions by applying a shearing force to the ink layer.

18. The method of claim 17, wherein applying a shearing force comprises delivering a flow of a gas across the surface of the ink layer.

19. The method of claim 17, wherein applying a shearing force comprises sweeping a blade across the surface of the ink layer.

20. The method of claim 19, wherein the blade is characterized by a durometer hardness of about 50 Shore A, or less.

21. The method of claim 17, wherein applying a shearing force comprises rolling a cylindrical roller across the surface of the ink layer.

22. The method of claim 17, further comprising generating a region of reduced air pressure in the vicinity of the ink layer.

23. The method of claim, 17, further comprising delivering a diluent to the ink layer.

24. The method of claim 23, wherein the diluent is delivered before the shearing force is applied.

25. The method of claim 23, wherein the diluent has the same composition as the electrically insulating carrier fluid.

26. The method of claim 23, wherein the diluent is delivered in the form of a spray.

27. The method of claim 17, wherein the act of applying a shearing force comprises directing a liquid spray toward the ink layer.

28. The method of claim 1, wherein the projected charge image corresponds to a desired final image, and the portion of the ink layer transferred comprises the charge-stiffened ink layer regions.

29. The method of claim 1 wherein performing the electrostatic transfer comprises charging the receptor substrate with a corona.

30. The method of claim 1 wherein performing the electrostatic transfer comprises applying an electrical bias to the receptor substrate.

31. The method of claim 30 wherein the electrical bias is applied by contact with an electrically biased roller.

32. The method of claim 1 wherein the receptor substrate comprises a print media.

33. The method of claim 1 wherein the receptor substrate comprises an elastomer image carrier.

34. The method of claim 33 further comprising transferring an image from the image carrier to a print media.

35. The method of claim 1, wherein the projected charge image corresponds to a reverse image of a desired final image, and the portion of the ink layer transferred comprises the non-charge-stiffened ink layer components to a receptor substrate.

36. An imaging system, comprising:

a surface;

an inking system operable to form on the surface of one of either an electrically insulating or electrically conductive layer an ink layer having an electrorheological fluid composition comprising a suspension of colorant particles dispersed in an electrically insulating carrier fluid;

a charge imaging print-head operable to project a charge image onto the ink layer to selectively form charge-stiffened regions adhering to the electrically insulating layer and representing respective regions of the projected charge image;

a developer assembly operable to apply a shearing force to the ink layer to physically separate non-charge-stiffened ink layer components from the charge-stiffened regions; and a transfer assembly operable to electrostatically transfer at least a portion of the ink layer to a receptor substrate.

37. The system of claim 36, wherein the surface is electrically conductive.

38. The system of claim 36, wherein the surface comprises an electrically insulating layer supported by an electrically conducting substrate.

39. The system of claim 36, wherein the projected charge image corresponds to a desired final image, and wherein the portion of the ink layer transferred comprises the charge stiffened ink layer regions.

40. The system of claim 36, wherein the projected charge image corresponds to a reverse image of a desired final image and the portion of the ink layer transferred comprises the non-charge-stiffened ink layer components.

* * * * *